US005685122A

United States Patent [19]

Brisbane et al.

[11] Patent Number: 5,685,122

[45] Date of Patent: Nov. 11, 1997

[54] METHOD AND APPARATUS FOR MAINTAINING AN AIR-SUPPORTED STRUCTURE

[75] Inventors: Steven W. Brisbane, Reston; Harold B. King, Jr., Lorton, both of Va.

[73] Assignee: Automated Air Structures, Inc., Fairfax Station, Va.

[21] Appl. No.: 438,769

[22] Filed: May 11, 1995

[51] Int. Cl.[6] ..... E04G 11/04; E04H 15/22

[52] U.S. Cl. ..... 52/745.07; 52/1; 52/2.11; 52/2.17; 52/173.1

[58] Field of Search ..... 52/1, 2.11, 2.17, 52/2.24, 2.25, 2.26, 63, 173.1, 741.1, 745.05, 745.06, 745.07

[56] References Cited

U.S. PATENT DOCUMENTS

| | | | |
|---|---|---|---|
| 2,910,994 | 11/1959 | Joy | 52/2.11 |
| 2,948,286 | 8/1960 | Turner | 52/2.17 X |
| 3,561,174 | 2/1971 | Schneidler | 52/2.17 X |
| 4,707,953 | 11/1987 | Anderson et al. | 52/63 |
| 4,936,060 | 6/1990 | Gelinas et al. | 52/1 |

FOREIGN PATENT DOCUMENTS

| | | | |
|---|---|---|---|
| 34725 | 11/1965 | Finland | 52/2.11 |
| 2218443 | 11/1973 | Germany | 52/2.11 |
| 13677 | 1/1991 | Japan | 52/2.11 |

OTHER PUBLICATIONS

"Structures with Interior Systems", Structures for Industry, Structures for Recreation, Pre-Engineered Dormitory Facility, & Commodity Storage Systems Collection of Brochures; Irvin Industries Inc.; Copyright 1975 and 1976.

*Primary Examiner*—Carl D. Friedman
*Assistant Examiner*—Kevin D. Wilkens
*Attorney, Agent, or Firm*—Lalos & Keegan

[57] ABSTRACT

The static pressure within an air-supported structure is monitored and controlled in accordance with monitored environmental conditions. The static pressure is kept at the minimum value required to maintain the structure's integrity, thereby using a minimum amount of energy. As outside wind velocity incrementally increases, the static pressure is increased incrementally. Under certain weather conditions such as high winds and frozen precipitation, the static pressure is increased to a maximum limit. As a safety feature, a secondary inflation device is activated to assist a primary inflation device to quickly increase pressure in the structure in response to a sudden loss in pressure.

20 Claims, 2 Drawing Sheets

METHOD AND APPARATUS FOR MAINTAINING AN AIR-SUPPORTED STRUCTURE

FIELD OF THE INVENTION

The present invention is related to structures such as shelters or enclosures that are supported by pressurized air, and more particularly to a system for maintaining the integrity of such structure with minimum energy consumption.

BACKGROUND OF THE INVENTION

Air-supported structures are now commonly used to cover and protect complexes, such as tennis courts, swimming pools or other sporting events and even meetings, conferences or other groupings of people. These complexes are found especially in areas of the country where participation in certain sports is limited or prohibited in the winter months. Air-supported structures have certain advantages over rigid buildings among which are a) they are less costly than comparable rigid buildings and, b) since they no longer require an extensive system of centrally located rigid support columns and lighting fixtures, they provide to people generally the same open feeling that rigid buildings offer.

While air-supported structures are relatively inexpensive to build, they can be fairly expensive to maintain since it is necessary not only to introduce continuously appropriately conditioned (i.e. heated or cooled) air into the structure to compensate for air losses, that inherently occur from minor leaks and door openings but also to compensate for changing environmental conditions. The integrity of the structure is also always at risk of collapsing from wind or snow resulting in costly repair expense and down time.

The operating costs resulting from energy use increase to condition the air according to the season and to meet integrity protection requirements during inclement weather. For example, when the weather conditions include high or gusty winds and/or frozen precipitation, the pressure inside the structure has been normally increased to the maximum limit tolerated by the people inside and permitted by the strength of the air-structure in order to maximize its rigidity for protection against collapse under the operating assumption that maximum rigidity meets the integrity requirements for any intermediate threatening condition. The precautionary measure of increasing pressure is normally taken by on-site maintenance personnel that visually check the weather conditions or weather forecast. Such precautionary measure is even taken in anticipation of inclement weather. Obviously, the integrity of the air structure depends upon the presence and decisive action of such personnel at these critical times.

Increasing the pressure in the structure to a maximum allowable limit greatly adds to the structure's energy costs because it requires the introduction of more outside air that must be conditioned. To err on the side of safety, typically, the operating personnel maintain the pressure at the allowable maximum during or in anticipation of the inclement weather, regardless of the actual weather conditions.

SUMMARY OF THE INVENTION

The present invention overcomes the disadvantages of prior systems in providing an automated monitoring and control system that maintains the integrity of the air-supported structure while minimizing energy use. For a particular structure, static pressure values are established empirically and will depend principally on the physical nature of the structure. These values include a static pressure set point that is the minimum static pressure required to maintain the structure's integrity under varying weather conditions, and a maximum value set point that is the maximum static pressure allowed without compromising structural integrity. These values are stored in a memory of a central controller, i.e. a computer.

The static pressure within the structure is monitored and such condition is input to the controller. The controller is also connected to a primary air flow device and regulates the primary air flow device such that the static pressure within the structure is maintained at the static pressure set point. The primary air flow device includes outside air dampers that are regulated to admit more outside air to increase inside pressure, and inside air dampers that are regulated to recirculate inside air to maintain or decrease inside pressure.

Environmental conditions including outside air temperature, wind velocity, and precipitation are monitored and such conditions are input to the controller. In response to an incremental increase in the monitored wind velocity, the static pressure set point is raised by an incremental value and the controller regulates the primary air flow device to increase pressure up to the new static pressure set point. If the monitored wind velocity decreases incrementally, the set point is automatically decreased incrementally, as is the structure's static pressure. With such automatic control, a minimum amount of energy is used since the static pressure is maintained at the set point that is the minimum value required to support the structure under the environmental conditions extant. This static pressure set point varies or floats in accordance with the monitored wind conditions.

If the wind velocity rises above a predetermined danger value, e.g. 25 miles per hour, the static pressure in the structure is automatically raised to the maximum value set point. Similarly, if precipitation is detected and the outside temperature is below a predetermined value, e.g. 36 degrees Fahrenheit, the static pressure is automatically raised to the maximum value set point. Thus, only in extreme weather conditions is the structure's static pressure raised to the maximum value. Otherwise, the pressure is automatically incrementally maintained at the minimum value allowed for the incrementally changed current wind conditions, thereby using minimal energy.

As a safety feature, a static pressure low limit safety set point is established. This low limit safety set point is a predetermined value, e.g. 0.2 inches water static pressure, below the current static pressure set point. If the structure's monitored pressure falls below the low limit safety set point, a secondary air flow device is activated to raise the static pressure back up to the current static pressure set point. The secondary air flow device is then deactivated and the pressure is again maintained by the primary air flow device. This secondary air flow device and the low limit safety set point feature ensure the structure's integrity by providing a quick rise in pressure when there is an unexpected loss in pressure due, for example, from an open door or a tear in the structure's fabric.

The present invention provides an automatic pressure control system that alleviates the need for continuous monitoring and control by on-site personnel, and provides considerable energy savings by maintaining the structure's static pressure at the lowest acceptable value.

DETAILED DESCRIPTION

Figure 1:
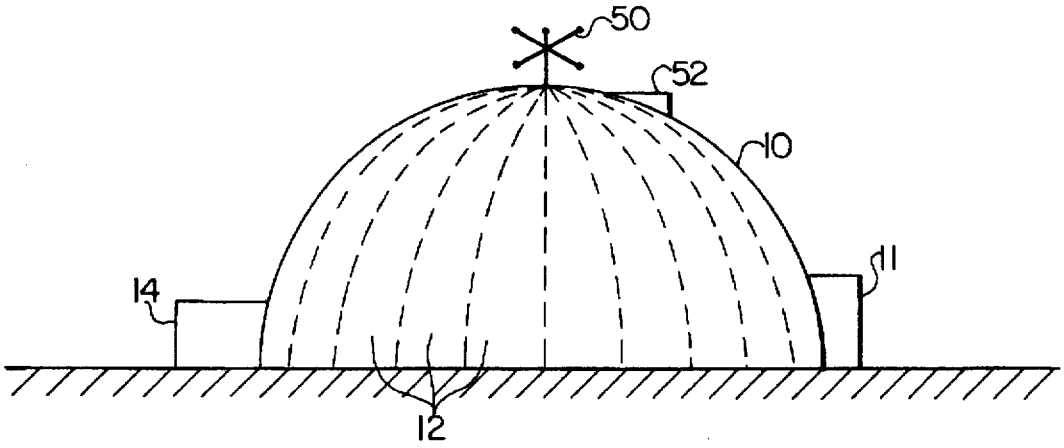
FIG. 1 is a perspective view of an air-supported structure and control system of the present invention.

An example of an air-supported structure is shown generally as 10 in FIG. 1. Structure 10 will comprise an inflatable sheet 12 that forms the sides and roof, and which may be made of plastic such as polypropylene or the like or a water-resistant cloth, for example. Structure 10 will also include an entrance 11, such as a conventional sealed revolving door. The automatic static pressure control system of the present invention is shown generally as 14.

Figure 2:
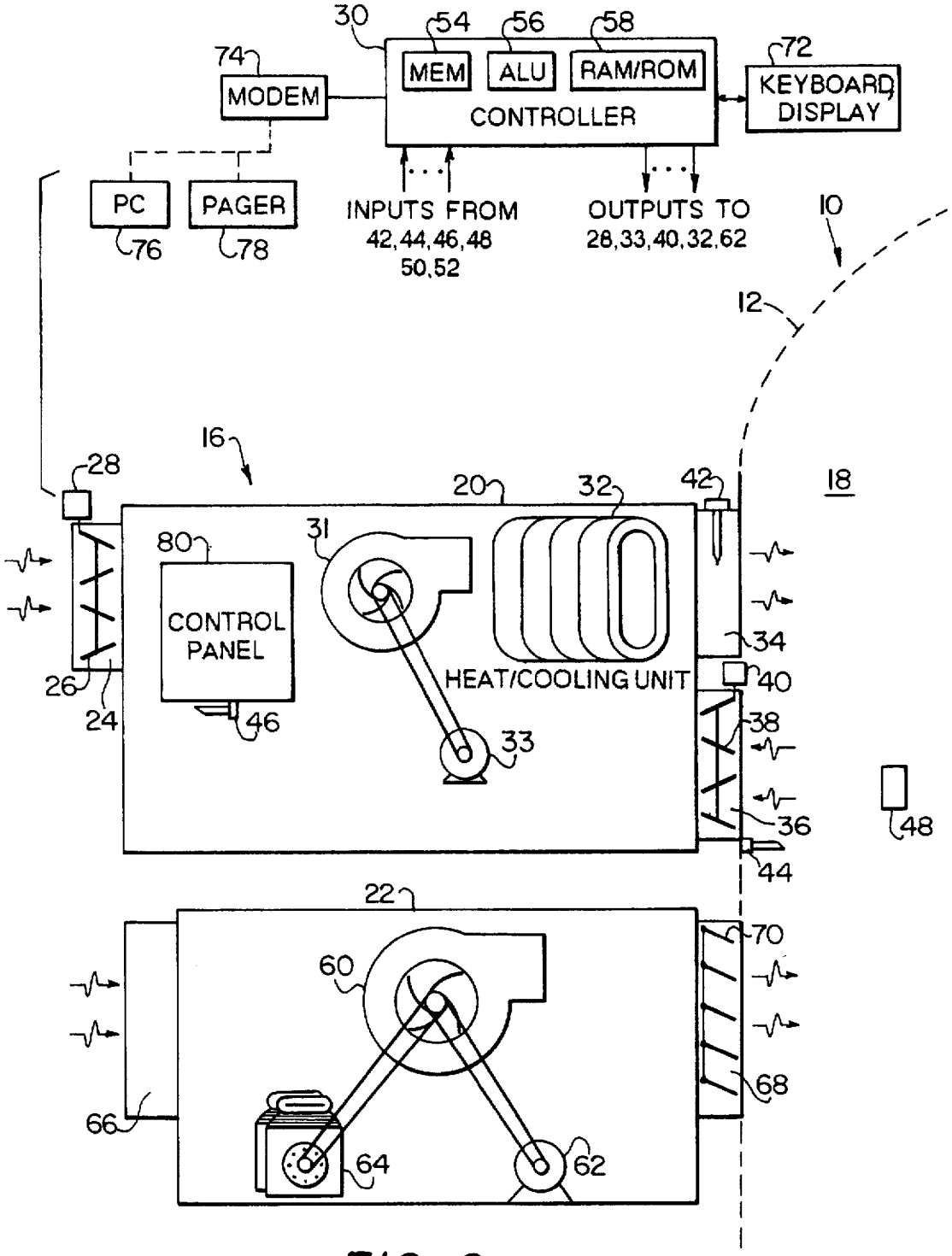
FIG. 2 is a diagrammatic illustration of the monitoring and control system of the present invention.

Control system 14 includes inflation unit 16, as shown in FIG. 2. Inflation unit 16 is in communication with the interior 18 of structure 10 via openings in sheet 12, as is conventional. Unit 16 includes primary air flow device 20 and secondary air flow device 22. Outside air is admitted into unit 20 through opening 24, the size of which is regulated by the positions of outside air dampers 26. Dampers 26 are controlled by outside air damper motor 28, which is in turn controlled by a programmable controller, shown generally as 30 in FIG. 2.

Fan 31 is driven by primary fan motor 33, which is controlled by controller 30. Fan 31 provides the primary air flow from ingress primary air flow device 20 into structure 10 through opening 34 and heating and cooling unit 32, which either heats or cools the air prior to its introduction into structure 10. Inside air is returned into device 20 through opening 36, the size of which and therefore the volume passing through is regulated by rotatable return air dampers 38. The angle of the dampers 38 is controlled by inside air damper motor 40, which is in turn controlled by controller 30. The temperature of the air supplied to the structure is monitored by supply temperature sensor 42. The temperature of the air in the structure's interior 18 is monitored by return air sensor 44, and the outside air temperature is monitored by outside air temperature sensor 46. Each of these monitored temperatures is input to the controller 30, which can be programmed to control the heating and cooling unit 32 such that a desired temperature is maintained in the structure. Of course, the user may wish to program the controller to vary the temperature in accordance with the time of day, intended use of the structure and any other user-defined variable.

The static pressure (e.g. water static pressure) in structure 10 is monitored by static pressure sensor 48, and such monitored pressure is input into controller 30. Controller 30 is programmed to control the static pressure in the structure by controlling outside air dampers 26 and return air dampers 38 through control of damper motors 28 and 40, respectively. As will be described in greater detail hereinafter, in order to minimize energy consumption, the static pressure in the structure is kept at the lowest value that is sufficient to maintain the structure's integrity under varying weather conditions. This low static pressure is achieved by reducing the intake of outside air by closing the outside air dampers 26 and opening the return air dampers 38. In cold weather, this results in unit 32 heating a larger amount of warmer return (inside) air, thereby reducing heating costs. In warm weather, this results in unit 32 cooling a larger amount of cooler return air, thereby reducing cooling costs.

As weather conditions vary, the minimum static pressure required to maintain the structure will also vary. Generally, as wind velocity increases, the static pressure must be increased to make the structure more rigid and able to withstand the force of the wind. Also, during periods of frozen precipitation (snow and ice), the static pressure is raised to rigidify the structure against the added weight of the snow or ice. To account for these varying weather conditions, environmental conditions including wind velocity, precipitation and outside air temperature are monitored in the system of the present invention. Wind velocity is monitored by wind velocity sensor (anemometer) 50 and precipitation is monitored by precipitation sensor 52, both shown in FIG. 1. Outside air temperature is monitored by outside air temperature sensor 46 (FIG. 2). Each of these monitored environmental conditions is input into controller 30.

Controller 30 may be any conventional programmable controller, but is preferably one that is well suited to accepting a number of analog or digital inputs (e.g. from sensors) and for providing a number of outputs (analog, digital and/or pneumatic) for controlling a number of devices (e.g. electrical motors, heating and cooling units, etc.). One such commercially available controller is the Infinity TCX 850 family, stand alone controller, available from Andover Controls Corporation, Andover, Mass. Controller 30 is programmed, using conventional programming techniques, to control the various devices on the basis of various sensed inputs. Specifically, in the present invention, the static pressure in structure 10 is controlled (via outside dampers 26 and return dampers 38) in accordance with the monitored environmental conditions.

In the present application, certain static pressure values are established. These values must be established empirically for each application of the present invention and will depend principally on the physical nature of the structure. The static pressure values that are established include a static pressure set point that is the minimum static pressure required to maintain the structure's integrity under varying weather conditions. For example, with the wind velocity at less than 10 miles per hour (m.p.h.) and no frozen precipitation, the static pressure set point for structure 10 may be 0.40 inches water static pressure (w.s.p.). This value is stored in a memory 54 of controller 30. As the monitored wind velocity increases incrementally, this static pressure set point is also increased incrementally in a manner that may be, though not necessarily, proportionally.

Controller 30 is programmed to calculate (e.g. via arithmetic and/or logic unit 56) an increase in the static pressure set point reflecting the incremental change in the monitored wind speed. The controller program is typically stored in a memory such as random access memory (RAM) or read only memory (ROM) 58. Conventional programming languages and techniques are well known in the art and a detailed discussion is not required to understand or appreciate the present invention.

The precise relationship between the static pressure set point and wind speed can be defined by the user to suit his or her particular application. For example, the incremental increase in wind velocity may result in a directly proportional increase in the static pressure set point. Alternative proportional relationships e.g. indirectly proportional or nonlinear, may be well suited to certain applications. Such indirect or nonlinear relationships could include integral, derivative, square, etc. A non-proportional relationship may also be used wherein incremental changes in wind velocity simply produce incremental changes in the static pressure set point. A preferred example of a proportional relationship between the static pressure set point and wind speed is the following directly proportional, i.e. linear, relationship:

| Wind Velocity (m.p.h.) | Static Pressure (inches) |
|---|---|
| 10 or less | .40 |
| 11 | .44 |
| 12 | .48 |
| 13 | .52 |
| 14 | .56 |
| 15 | .60 |
| 16 | .64 |
| 17 | .68 |
| 18 | .72 |
| 19 | .76 |
| 20 | .80 |
| 21 | .84 |
| 22 | .88 |
| 23 | .92 |
| 24 | .96 |
| 25 | 1.00 |
| greater than 25 | 1.40 |

In the above example, when the wind velocity is 10 m.p.h. or less, the static pressure set point is 0.40 inches water static pressure (w.s.p.). If, for example, the wind velocity (as monitored by sensor 50) increases to 16 m.p.h., controller 30 calculates the new static pressure set point to be 0.64 inches w.s.p. and stores this value in memory 54. Controller 30 then controls outside and return air dampers 26 and 38, respectively, (via motors 28 and 40) to maintain the static pressure within the structure (as monitored by sensor 48) at the adjusted static pressure set point (i.e. 64 inches w.s.p.). If the. wind velocity thereafter decreases or increases, the static pressure set point is adjusted up or down in proportion to the wind velocity increase or decrease.

As shown above, the increments are in 1 mph units above 10 mph to produce incremental increases of 0.4 inches of static pressure above 0.4 inches. The increments, however, may be in any quantitative numerical value of mph, i.e. 3, 5, 8 or 9 mph with attendant increases, that need not be proportional, in the static pressure, for example, 0.09, 0.17, 0.30 and 0.39 inches respectively. Thus, the incremental changes in the static pressure set point vary in accordance with the incremental changes in the wind velocity.

With the automatic control system of the present invention, the static pressure set point is set at the minimum value required to maintain the structure's integrity under varying weather conditions. This ensures that, under such varying weather conditions, the minimum energy is consumed. As compared with the prior practice of increasing the static pressure to the maximum allowable value in response to any inclement weather, the system of the present invention provides precise control over the static pressure, commensurate with the actual weather conditions experienced. As seen from the above tabulated relationship between the static pressure set point and wind velocity, only under the extreme condition of wind velocity in excess of 25 m.p.h is the static pressure set point raised to its maximum value of 1.40 inches w.s.p. Otherwise a lesser value is selected, minimizes energy costs.

The present invention takes in to account one other environmental condition in which the static pressure set point is raised to its maximum value. This condition is frozen precipitation. The present invention senses precipitation via sensor 52, and outside temperature via sensor 46. In a preferred embodiment, if precipitation is detected and the outside temperature is less than 36 degrees Fahrenheit, the static pressure set point is set to its maximum value of 1.40 inches w.s.p.

The present invention also includes a safety feature that remedies an unexpected loss in pressure. This could occur, for example, from an open door or a tear in the structure's fabric. To account for such an unexpected loss in pressure, a static pressure safety set point is established. This safety set point is a predetermined value, e.g. 0.2 inches w.s.p., below the static pressure set point for the current weather conditions. Keeping with the example set forth hereinabove, if the wind velocity is 10 m.p.h. or less and the static set point is 0.40 inches w.s.p., the static pressure safety set point (stored in memory 54) is set at 20 inches w.s.p.

If the wind velocity increases to 16 m.p.h., the static pressure set point is preferably increased by controller 30 to 0.64 inches w.s.p. and controller 30 also preferably increases the safety set point to 0.44 inches w.s.p. (0.64–0.20 inches w.s.p.). The static pressure safety set point floats with, and remains a predetermined value less than the static pressure set point. Thus, in the extreme conditions of wind velocity in excess of 25 m.p.h. or frozen precipitation, the static pressure safety set point is set at 1.20 inches w.s.p., using the example values set forth above.

If the static pressure in the structure, as monitored by sensor 48, falls below the static pressure safety set point controller 30 energizes secondary air flow device 22 to quickly raise the static pressure back up to the static pressure set point by increasing air flow ingress. Thereafter, secondary air flow device 22 is deactivated and primary air flow device 20 alone maintains the static pressure in structure 10 at the static pressure set point.

Secondary air flow device 22 includes fan 60 that, under normal circumstances, is driven by secondary fan motor 62, which is controlled by controller 30. Natural gas or gasoline powered motor 64 provides a back-up drive for fan 60 and is used to keep structure 10 inflated when electrical power is lost. Outside air is admitted into secondary air flow device 22 through opening 66. The outside air is forced into the interior 18 of structure 10 through opening 68. Dampers 70 are normally closed by gravity but are opened by the air forced from fan 60. Secondary air flow device 22 is activated when the monitored static pressure falls below the static pressure safety set point. Controller 30 starts motor 62 to drive fan 60 and force more outside air into structure 10 to raise the static pressure back to the static pressure set point. In an emergency, when electrical power is lost, gas powered motor 64 is started to drive fan 60 and keep structure 10 inflated until electrical power is restored.

Alternatively, it is possible to omit the use of the secondary air flow device, except for loss of electrical power, for instance, and increase the speed of the fan 31 as by increasing the speed of the driving motor 33 in any conventional manner to thereby increase air flow ingress. Thus the speed of fan 31 will be at its maximum when the static pressure safety set point is breached but will fall to normal speed when the static pressure set point is reached.

The present invention includes a conventional user interface 72 (e.g. keyboard and display) for programming and data input and retrieval. A modem 74 connected between controller 30 and personal computer (PC) 76 is provided to allow remote PC access or automatic dial out to a personal pager 78 for alarm notification. Further, a control panel 80 is located on primary air flow device 20 to permit conditions to be monitored and allow manual override of controller 30.

From the foregoing detailed description, it will be evident that there are a number of changes, adaptations and modifications of the present invention that will occur to those having ordinary skill in the art to which the invention pertains.

However, it is intended that all such variations not departing from the spirit of the invention be considered within the scope thereof as limited solely by the appended claims, wherein

We claim:

1. A method of maintaining an air-supported structure comprising:

establishing in a controller an initial static pressure set point at which the static pressure in said air-supported structure is maintained for safe and economic operation;

monitoring the static pressure within said structure and forming an output signal representative of the static pressure;

monitoring the following environmental conditions surrounding said structure: 1) wind velocity, 2) precipitation and forming respective individual output signals representative of said monitored environmental conditions;

inputting said respective individual output signals to said controller;

generating control signals in said controller from said individual output signals;

adjusting said initial static pressure set point by a value reflecting a change in said monitored environmental conditions to form an adjusted static pressure set point; and responsive to said monitored static pressure and said respective individual output signals input to said controller, increasing air flow ingress using control signals generated using said controller to raise the static pressure within said structure at said adjusted static pressure set point.

2. A method as in claim 1 wherein said step of increasing the static pressure within said structure includes the step of controlling a primary air flow device to increase the ingress of outside air into said structure.

3. A method as in claim 2 wherein said step of controlling a primary air flow device includes the step of regulating at least one outside air damper for said primary air flow device.

4. A method as in claims 1 or 2 wherein said step of increasing the static pressure within said structure includes the step of controlling the flow of return air to said structure.

5. A method as in claim 4 wherein said step of controlling the flow of return air includes the step of regulating at least one inside air damper.

6. A method as in claim 1 wherein said step of adjusting said initial static pressure set point is incremental and includes the step of raising said initial static pressure set point according to an incremental increase in said monitored wind velocity.

7. A method as in claim 1 further including the steps of:

assigning a static pressure safety set point that is a predetermined value below said adjusted static pressure set point;

increasing air flow ingress to raise said structure static pressure to said adjusted static pressure set point in response to said monitored static pressure being below said static pressure safety set point for said adjusted static pressure set point.

8. A method as in claim 7 wherein said predetermined value is 0.2 inches water static pressure.

9. The method of claim 7 including, said increasing of said air flow ingress includes a secondary air flow source.

10. A method as in claim 1 further including the steps of:

assigning a static pressure maximum value set point; and, increasing said air flow ingress with a primary air flow device to raise the static pressure within said structure to said maximum value set point in response to said monitoring step indicating precipitation and a predetermined outside temperature.

11. A method as in claim 10 wherein said predetermined outside temperature is less than 36 degrees Fahrenheit.

12. A method as in claim 1 further including the steps of:

assigning a static pressure maximum value set point; and, increasing said air flow ingress to raise the static pressure within said structure to said maximum value set point in response to said monitoring step indicating a wind velocity in excess of a predetermined value.

13. A method as in claim 12 wherein said predetermined value is 25 miles per hour.

14. A method of maintaining an air-supported structure comprising:

establishing in a controller an initial static pressure set point at which the static pressure in said air-supported structure is maintained for safe and economic operation;

monitoring the static pressure within said structure and forming an output signal representative of the static pressure;

monitoring at least one environmental condition surrounding said structure, said at least one environmental condition including wind velocity and forming at least one output signal representative of said at least one environmental condition;

inputting said at least one output signal to said controller;

generating at least one control signal in said controller from said at least one output signal;

adjusting said initial static pressure set point incrementally to form an adjusted static pressure set point reflecting an incremental change in said monitored wind velocity; and responsive to said monitored static pressure and said output signal input to said controller, increasing air flow ingress using control signals generated using said controller to maintain the static pressure within said structure at said adjusted static pressure set point.

15. A method as in claim 14 further including the steps of:

assigning a static pressure safety set point that is a predetermined value below said adjusted static pressure set point;

increasing air flow ingress to raise said structure static pressure to said adjusted static pressure set point in response to said monitored static pressure falling below said safety set point for said adjusted static pressure set point.

16. The method of claim 15 including, said increasing of said air flow ingress includes a secondary air flow source.

17. A method as in claim 14 further including the steps of:

assigning a static pressure maximum value set point; and, increasing said air flow ingress with a primary air flow device to raise the static pressure within said structure to said maximum value set point in response to said monitoring step indicating a wind velocity in excess of a predetermined value.

18. A method as in claim 17 wherein said predetermined value is 25 miles per hour.

19. A method as in claim 14 wherein said at least one environmental condition further includes precipitation and outside temperature and further including the steps of:

assigning a static pressure maximum value set point; and, increasing said air flow ingress to raise the static pressure within said structure to said maximum value set point in response to said monitoring step indicating precipitation and a predetermined outside temperature.

20. A method of maintaining an air-supported structure comprising:

monitoring the static pressure within said structure and forming an output signal representative of the static pressure;

monitoring the following environmental conditions surrounding said structure: 1) wind velocity, 2) outside temperature, and 3) precipitation and forming respective individual output signals representative of said monitored environmental conditions;

inputting said respective individual output signals to a controller;

generating control signals in said controller from said individual output signals;

responsive to said monitored static pressure and said respective individual output signals input to said controller, increasing air flow ingress using control signals generated using said controller to raise the static pressure within said structure.

* * * * *